US005115527A

United States Patent [19]

Medley

[11] Patent Number: 5,115,527

[45] Date of Patent: May 26, 1992

[54] SUPPORT PAD WITH SPACED, PARALLEL LONGITUDINAL CHANNELS AND SUPPORT ELEMENTS

[76] Inventor: Anthony M. Medley, 23 Langdale Rise, Colne, Lancashire, United Kingdom, BB8 7RA

[21] Appl. No.: 587,030

[22] Filed: Sep. 24, 1990

[30] Foreign Application Priority Data

Jul. 23, 1990 [GB] United Kingdom ..... 9016134

[51] Int. Cl.[5] ..... A47C 27/14

[52] U.S. Cl. ..... 5/481; 5/468

[58] Field of Search ..... 5/481, 469, 468, 464, 5/448, 420; D6/606

[56] References Cited

U.S. PATENT DOCUMENTS

| | | | |
|---|---|---|---|
| D. 307,689 | 5/1990 | Schaffer | D6/606 |
| D. 307,690 | 5/1990 | Raburn | D6/606 |
| 3,885,257 | 5/1975 | Rogers | 5/481 |
| 4,070,719 | 1/1978 | Morgan | 5/468 |
| 4,620,337 | 11/1986 | Williams et al. | 5/481 |
| 4,862,538 | 9/1989 | Spann et al. | 5/481 |
| 4,901,387 | 2/1990 | Luke | 5/481 |
| 5,007,124 | 4/1991 | Raburn et al. | 5/481 |

FOREIGN PATENT DOCUMENTS

| | | | |
|---|---|---|---|
| 2856758 | 7/1980 | Fed. Rep. of Germany | 5/481 |
| 1559851 | 1/1980 | United Kingdom | 5/481 |

*Primary Examiner*—Alexander Grosz

*Attorney, Agent, or Firm*—Shapiro and Shapiro

[57] ABSTRACT

A support for pressure sore preventation in a patient such as a hospital or accident patient is made in one piece from plastic foam material and comprises a flexible support surface defined by a plurality of discrete elongate support elements defining the surface, the elements being spaced apart by elongate blind channels, wider at the base than at the surface, for promoting circulation of air adjacent to the support surface.

4 Claims, 2 Drawing Sheets

SUPPORT PAD WITH SPACED, PARALLEL LONGITUDINAL CHANNELS AND SUPPORT ELEMENTS

The invention relates to a device for pressure sore prevention in a patient.

Pressure sores have a number of names, for example ischaemic ulcers, decubitus ulcers, pressure ulcers, or bed sores.

Decubitus ulcers (or pressure sores) are caused by three main forces, namely pressure, friction and shear forces.

A combination of one or more of these forces with other factors which predispose to the development of pressure sores greatly increases the risk of pressure sore development.

Identification of those patients who are at risk, regular re-positioning of the patient, careful inspection and care of the skin, and the use of effective pressure re-distribution products has been shown to prevent between 75–80 percent of pressure sores from occurring.

Pressure sores or decubitus ulcers generally develop when a mechanical pressure is exerted on tissues for prolonged periods. The local capillary systems are occluded, and the tissues are deprived of oxygen, minerals and nutrients. Therefore tissues which are already compromised in an ill patient, having pressures exerted at any of the numerous prominances or tuberosities, can very quickly necrose and develop into a decubitus ulcer, sometimes becoming so bad that they become life threatening.

Statistics in the United Kingdom show that about 8% of patients in health care develop pressure sores. A further 8% admitted to hospital care are at risk of developing pressure sores because of debilitating factors.

The cost of treating a single patient with a single pressure sore has been shown to be around £ 27,000.

It is thus an object of the invention to provide a device which is relatively inexpensive yet efficient in reducing the incidence of bed sores.

According to the invention there is provided a device for pressure sore prevention in a patient, comprising a flexible support surface defined by a plurality of discrete support elements which are spaced apart by means to provide for circulation of air adjacent the support surface.

Suitably the device may be integrally made from a plastic foam material.

A device may comprise a body an upper (in use) part of which may be formed by the discrete support elements which each may comprise an elongate member having a head and a shank of less width than the head.

The means to provide circulation of air may comprise an elongate channel between adjacent support elements.

The channels may each comprise a narrower part open at the surface between adjacent elements and a wider, blind part in the body and undercutting the heads of adjacent elements.

The discrete elements and channels may be formed by a knife.

The body may be compressed before application of the knife.

The device may be provided in combination with a cover.

A device embodying the invention for pressure sore prevention in a patient is diagrammatically illustrated, by way of example, in the accompanying drawings.

Figure 1:
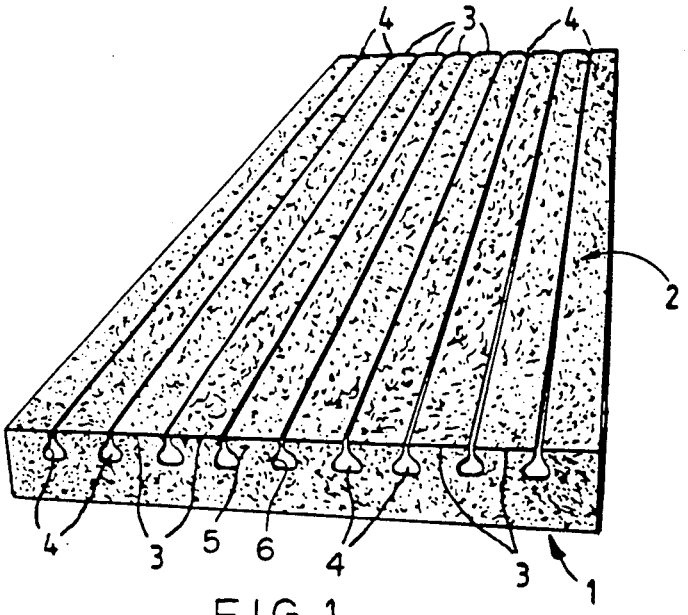
FIG. 1 is a perspective view of a device according to the invention.

Referring to the drawings there is shown a device 1 for purpose sore prevention in a patient P, comprising a flexible support surface 2 defined by a plurality of discrete support elements 3 which are spaced apart by means in the form of channels 4 for circulation of air adjacent the support surface 2.

As best seen in FIG. 1, the lower portion of device 1 is comprised of a generally rectangular block of resilient foam material defined by generally parallel and vertical head and foot ends, and generally parallel sides. The support elements 3 which form the upper part of the device 1 are generally parallel with the sides of the block and extend from the head end of the block to the foot end of the block.

The device 1 comprises an integral foam plastic body having flame retardancy to B.S. 5852 Part 2 Ignition Source 5, the discrete support elements 3 being, where the device 1 is an elongate mattress-like device, substantially parallel elongate supports or slats each having a head 5 of approximately semi-elliptical cross-section as shown, the head 5 leading to a narrower stem or shank 6 which in turn merges with the body of foam.

Each elongate support element 3 is separated from an adjacent one by an air channel 4 which is blind, the opening 7 of the channel to the surface 2 being narrower than a wider, blind part 8 of approximately elliptical cross-section and of narrower width than the adjacent shank portions, as shown, which blinds part extends laterally into the foam to undercut the heads 5 of the adjacent elements 3. All the corners are rounded to provide for smooth surfaces which flex readily without tending to destroy the foam.

In use, the device 1 is laid on a support such as a bed, whether in hospital or at home, or on a stretcher. When a patient P lies down on the device 1 the support surface 2 deforms to conform to, fill, and envelop body contours of the patient.

This results in the support elements 3 giving equal thrust on a maximum body surface area of the patient P and so reducing interface pressure below that required for capillary occlusion in the patient, and thus in turn prevents the formation of pressure sores.

The deformation of the support surface 2 is effected by the support elements flexing about their shanks 6 to close the openings 7 of the air channels 4 or at least reduce their lateral dimension to accommodate the movement of the elements. At the same time the air channels 4 are maintained unobstructed over the length of the device 1 over most of the surface area 2 of the device 1, even if one or two are temporarily closed by the weight of the patient. As the patient moves, channels closed at the surface open and others close. This ensures that air always flows freely through the channels 4, and any patient movement increases this air exchange through the system, keeping the patient cool (by dispersing heat) and dry, eliminating skin tissue maceration, and obviating pathogenic growth and cross infection.

Figure 2:
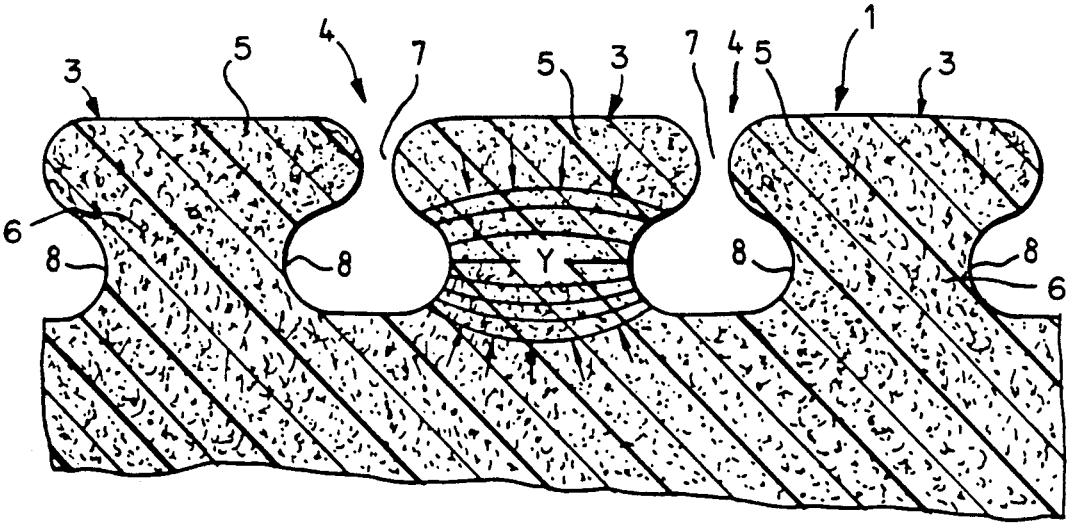
FIG. 2 is an enlarged and elevational view of part of the device of FIG. 1.
Figure 3:
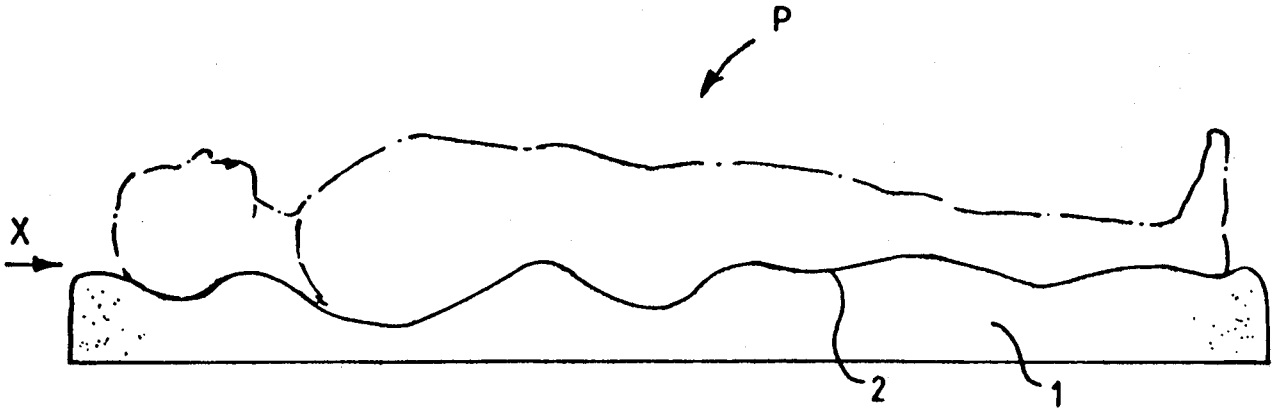
FIG. 3 shows schematically a view of a whole of a device in use.
Figure 4:
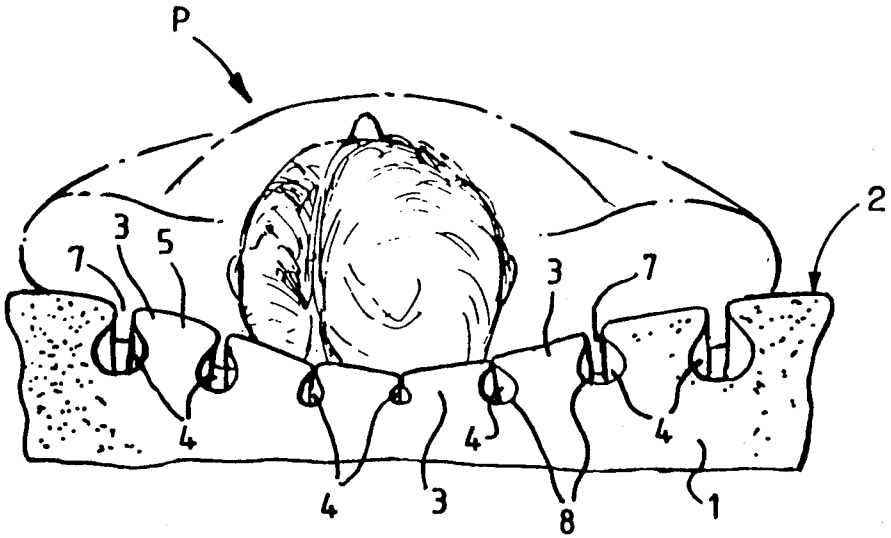
FIG. 4 shows an enlarged view of a support surface of FIG. 3 taken in the direction 'X' of FIG. 3.

The device 1 acts to reduce the interface pressure between the patient and the device by providing equal thrust over the maximum body surface area, the pressure applied being dissipated at the weakest point, which is shown at "Y" in FIG. 2, this being the narrowest point between two adjacent air channels.

The device 1 may be in the form of a cushion or exercise mat, and may be enclosed in a suitable covering for example a waterproof, low friction, anti-static cover.

I claim:

1. A device for pressure sore prevention in a patient, comprising a generally rectangular block of resilient foam material defined by generally parallel and vertical head and foot ends, and generally parallel sides, said block having a main body portion with a plurality of substantially parallel elongate support elements projecting from one side thereof, said support elements being generally parallel with the sides of the block and extending from the head end of the block, to the foot end of the block, said support elements comprising respective flat-topped head portions of generally semi-elliptical cross-section and respective shank portions of narrower width than the corresponding head portions and joining the head portions to said main body portion, with adjacent support elements being spaced apart by elongate channels each including a narrow part open between the head portions of the adjacent support elements and a wider blind part of approximately elliptical cross-section undercutting the head portions of the adjacent support elements and of smaller width than the shank portions thereof, the support elements defining and extending continuously over a substantially flat resilient support surface effective to maintain interface pressure between the surface and a patient resting thereon sufficiently low as to prevent capillary occlusion in the patient.

2. A device as defined in claim 1, wherein the discrete elements and channels are formed by a knife.

3. A device as defined in claim 2, wherein the body is compressed before application of the knife.

4. A device as defined in claim 1, wherein the device is mounted within a cover.

* * * * *